US006536952B1

(12) United States Patent
Hsieh

(10) Patent No.: US 6,536,952 B1
(45) Date of Patent: Mar. 25, 2003

(54) LAUNDRY NET POCKET FOR A WASHING MACHINE

(76) Inventor: Yun Yun Hsieh, PO Box 82-144, Taipei (TW)

( * ) Notice: Subject to any disclaimer, the term of this patent is extended or adjusted under 35 U.S.C. 154(b) by 0 days.

(21) Appl. No.: 09/963,507

(22) Filed: Sep. 27, 2001

(51) Int. Cl.[7] ..... B65D 30/06

(52) U.S. Cl. ..... 383/117; 383/119; 220/9.1

(58) Field of Search ..... 383/119, 22, 24, 383/104, 127, 907, 117; 220/9.1, 9.2, 9.3, 9.4

(56) References Cited

U.S. PATENT DOCUMENTS 476,862 A * 6/1892 Bates ..... 383/119
692,405 A * 2/1902 Wright ..... 220/493
692,406 A * 2/1902 Wright ..... 220/493
1,652,387 A * 12/1927 Barber ..... 206/315.11
2,509,537 A * 5/1950 Stier ..... 220/9.1
4,429,659 A * 2/1984 Holyoak ..... 119/223
4,865,463 A * 9/1989 Howard ..... 383/117
4,974,967 A * 12/1990 Tsuyoshi et al. ..... 383/102
5,009,189 A * 4/1991 Neff ..... 119/200
5,113,537 A * 5/1992 Turk ..... 135/90
5,320,429 A * 6/1994 Toyosawa ..... 383/117
5,810,191 A * 9/1998 Conrelious ..... 220/493
5,964,533 A * 10/1999 Ziglar ..... 220/9.2

* cited by examiner

*Primary Examiner*—Jes F. Pascua
(74) *Attorney, Agent, or Firm*—Leong C. Lei

(57) ABSTRACT

An improved structure of a net pocket for a laundry machine comprised of a laundry net pocket, support tubes and connectors. Those support tubes are provided on the inner side of the sewing seam of the net pocket and connectors are provided at where the support tubes are curved to connect the support tubes and provide a cubic space inside the net pocket in helping prevent lint, shrinkage and wrinkle of the laundry to improve a clean washing of the laundry.

1 Claim, 3 Drawing Sheets

LAUNDRY NET POCKET FOR A WASHING MACHINE

BACKGROUND OF THE INVENTION (a) Field of the Invention

The present invention relates to an improved structure of a laundry net pocket for a washing machine, and more particularly, to one that provides a supported cubic space to prevent lint, wrinkle and shrinkage of the laundry.

(b) Description of the Prior Art

While there are diversified of garments and apparatus available in the market today, those garments and apparatus are made of lighter, softer and finer fibers thanks to advanced technology, and various types of cleaning agents have been developed. However, smaller laundry, e.g., bra, underwear and pantyhose usually are put into a laundry net pocket before being put into a washing machine. Said laundry net pocket of the prior art is essentially of a sewn net pocket having an opening provided with, a zipper for access.

However, the laundry in the net pocket is vulnerable to get tangled that prevents a genuinely cleaning of the laundry. As a result, the primay purpose of the net pocket is supposed to help clean the laundry. Instead, the laundry gets more lint and can not be effectively cleaned to create more problems for the consumer. Therefore, an improved structure of the net pocket is possible and required.

SUMMARY OF THE INVENTION

The primary purpose of the present invention is to provide a laundry net pocket for a washing machine that has the laundry net pocket supported by a support frame comprised of multiples of tube adapted with connectors to offer a cubic space to accommodate the laundry that prevents it from being tangled it for effectively cleaning. To achieve the purpose, an improved structure of a laundry net pocket is comprised of multiples of support tubes, connectors and a net pocket. Those support tubes are inserted on the inner side of the sewn beams inside the net pocket and are connected at its both ends with connectors to form a cubic net pocket for containing the laundry. The laundry net pocket effectively protects the laundry without creating lint and prevents the laundry from being tangled, particularly applicable to the washing of cotton, nylon, T/C clothes, bra, underwear and pantyhose.

The foregoing object and summa provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon maldng reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
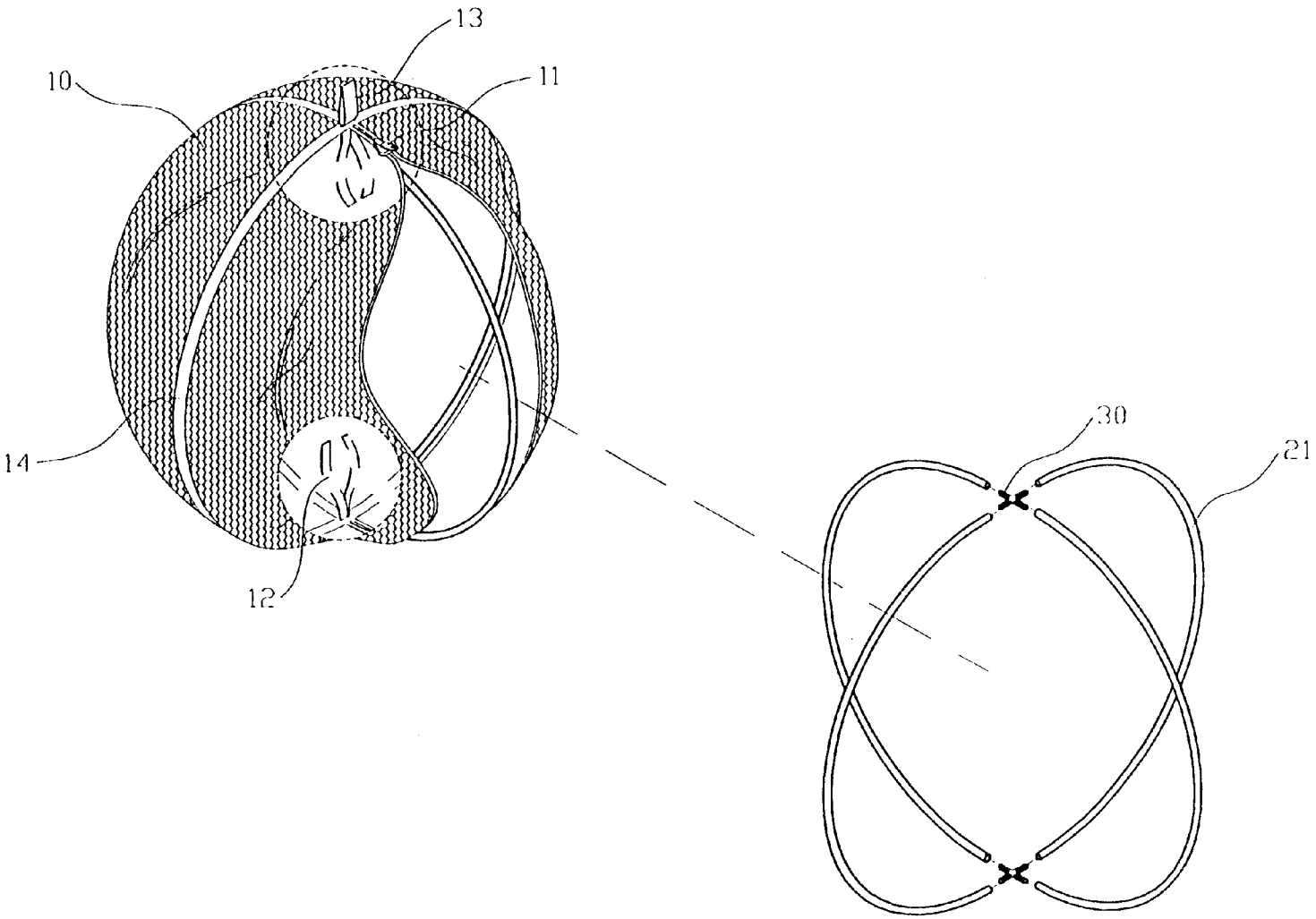
FIG. 1 is a schematic view showing a structure of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
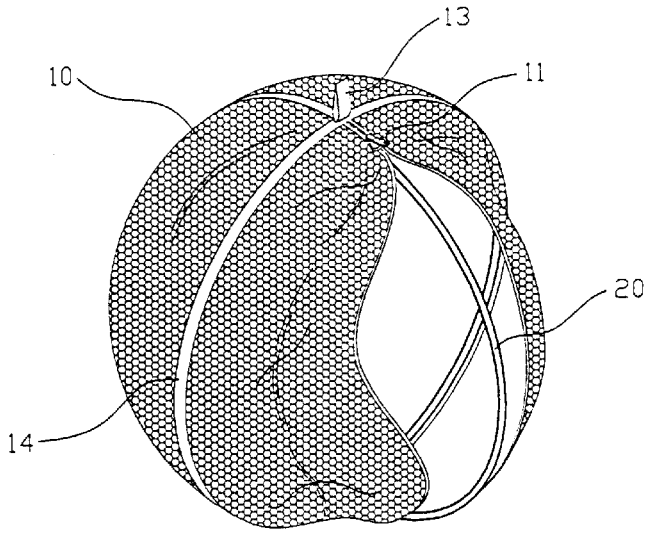
FIG. 2 is a perspective view of a net pocket provided with support tubes of the present invention.
Figures 3A, 3B, 3C, 3D:
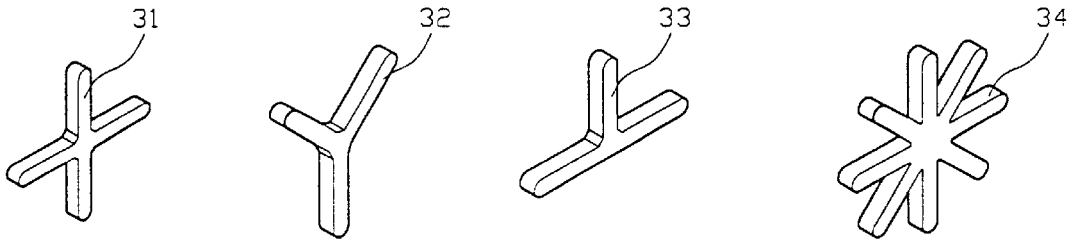
FIGS. 3A, 3B, 3C and 3D show different connectors of the present invention.
Figure 4:
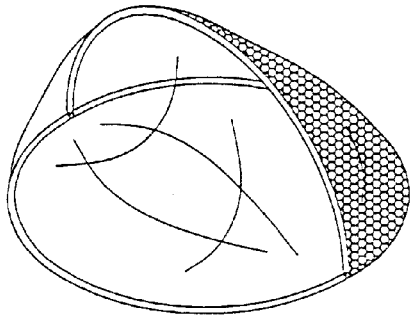
FIG. 4 is a schematic view of a preferred embodiment of the present invention having a triangle structure.
Figure 5A:
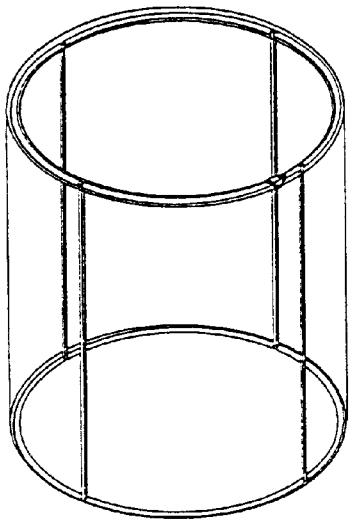
FIGS. 5A and 5B are schematic views of a preferred embodiment of the present invention having a cylindrical structure.
Figure 5B:
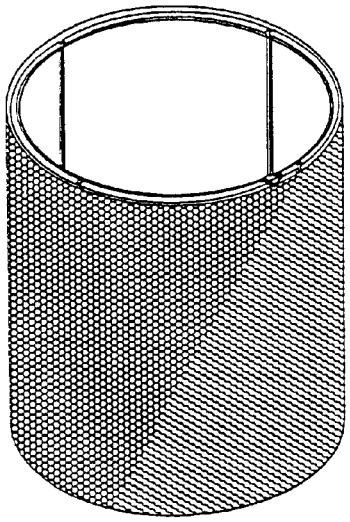

Referring to FIGS. 1 and 2 for an improved structure of a net pocket for a washing machine, it is essentially comprised of a laundry net pocket 10 sewn with four pieces of mesh having a zipper 11 provided to the opening as the access for the laundry. Two ropes (12) are sewn to each of the upper and the lower ends inside the net pocket to fasten the support frame 20 inside the net pocket. A hook band 13 is sewn to the top edge outside the net pocket to suspend the net pocket containing the laundry inside the washing machine. The support frame 20 is comprised of multiples of support tubes 21 with each made of hollow PE tube. Each of those connectors relate to a cross member 31 made of metallic material or PU respectively inserted into both the upper and lower ends of each support tube 21, followed with the insertion in sequence of the rest of the support tubes. The support frame 20 then is put into the laundry net pocket 10 with the support tubes each resting on the inner side of the sewn seams 14 inside the net pocket to constitute a tetrahedral accommodation space, which is subject to change depending on the contour of the net pocket. The laundry inside the accommodation space will not get tangled because of being stretched up by the support frame 20 to increase cleaning efficiency in the alternatively changed currents inside the washing machine. Now referring to FIGS. 3A, 3B, 3C, 3D, 4, 5A and 5B for another preferred embodiment of the present invention, wherein, both of those support tubes 21 and connectors 30 together are applied in various forms of the laundry net pocket 10. The connector may be in the form of a cross 31, a Y-shape 32, an inverse T-shape 33 or a (-shape 34 as illustrated in FIGS. 3A–3D to be adapted to multiples of support tube to form the laundry net pocket allowing more options, such as a trihedral as illustrated in FIG. 4, a tetrahedral, a cylindrical as illustrated in FIGS. 5A and 5B or an ellipsoidal. As the support frame is comprised of PE tubes, it can withstand the currents inside the washing machine to prevent the laundry from being tangled. Furthermore, the laundry net pocket of the present invention allows easy packing for marketing purpose.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a laundry net pocket for a washing machine comprising support tubes, connectors and a net pocket, wherein said support tubes are inserted on an inner side of a sewing seam of said net pocket and their ends are linked with said connectors to stretch up inside said net pocket forming a cubic space to accommodate laundry, particularly to cotton, nylon, T/C clothes, pantyhose and under wear to effectively prevent them from generating lint and being tangled, and two ropes are sewn to each of upper and lower ends inside said net pocket to fasten a support frame provided inside said net pocket.

* * * * *